United States Patent [19]

Sommerhalder

[11] 4,441,581

[45] Apr. 10, 1984

[54] COMPONENT FOR AIRBORNE-SOUND INSULATION

[75] Inventor: Rudolf Sommerhalder, Affoltern a.A., Switzerland

[73] Assignee: Hawa AG., Mettmenstetten, Switzerland

[21] Appl. No.: 200,507

[22] PCT Filed: Dec. 10, 1979

[86] PCT No.: PCT/CH79/00156

§ 371 Date: Aug. 11, 1980

§ 102(e) Date: Jul. 30, 1980

[87] PCT Pub. No.: WO80/01184

PCT Pub. Date: Jun. 12, 1980

[30] Foreign Application Priority Data

Dec. 11, 1978 [CH] Switzerland ..... 12531/78

[51] Int. Cl.[3] ..... E04B 1/82; C04B 43/00

[52] U.S. Cl. ..... 181/286; 181/288; 181/290; 181/293; 181/294

[58] Field of Search ..... 181/286–294

[56] References Cited

U.S. PATENT DOCUMENTS

| | | | |
|---|---|---|---|
| 2,973,295 | 2/1961 | Rodgers, Jr. | 181/290 X |
| 4,241,806 | 12/1980 | Metzger | 181/286 X |

FOREIGN PATENT DOCUMENTS

| | | | |
|---|---|---|---|
| 1211370 | 5/1969 | Fed. Rep. of Germany . | |
| 2750439 | 5/1979 | Fed. Rep. of Germany | 181/294 |
| 7004047 | 3/1973 | France . | |
| 255026 | 6/1948 | Switzerland . | |
| 614558 | 12/1948 | United Kingdom . | |

*Primary Examiner*—Benjamin R. Fuller

*Attorney, Agent, or Firm*—Weingarten, Schurgin, Gagnebin & Hayes

[57] ABSTRACT

A plate-component (1) which can be used for airborne-sound insulation has chambers (5, 6) filled with a pulverulent or granular, e.g. metallic material, whose chamber walls (2, 3, 4) at least partly are formed by a flexible material. Chambers (5, 6) are small in the vertical direction, but in the horizontal direction can form long channels. This construction not only leads to an increase in the sound insulation of a board joined to component 1 corresponding to an increase in the weight per unit area, but it is also possible to prevent coincidence breakdowns in the range 100–3000 Hz.

7 Claims, 6 Drawing Figures

COMPONENT FOR AIRBORNE-SOUND INSULATION

Figure 1:
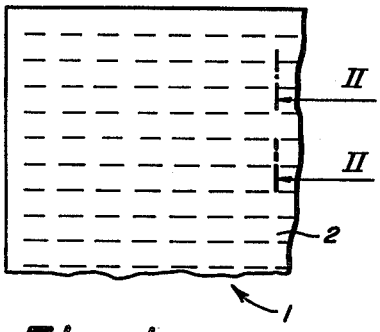

The invention relates to a component for airborne-sound insulation in plate or sheet-like form for incorporation into walls and ceilings.

The extent of the airborne-sound insulation of a wall is mainly dependent on its weight per unit area, i.e. its mass. In theory it is possible to derive from this the known mass law which reproduces the relationship between the weight per unit area of a wall and the transmission loss. However, measurements taken under practical conditions have shown that the transmission losses calculated according to the mass law are not achieved, because no account is taken of the elastic wall characteristics. If, with rising sound generating frequency, the wavelength in air becomes smaller than the flexural wavelength of the wall at a given frequency coincidence effects occur, resulting from the resonance between the acoustic excitation of the wall and the free flexural vibrations thereof and significantly reduce the transmission loss. This breakdown in the mass law due to coincidence effects is between 60 and 3200 Hz for most materials used in partitioning walls and it would appear impossible to reach the theoretical transmission loss in this range. Most plate-like wall or door elements have a weight per unit area of 6–40 kg/m$^2$. Comprehensive measurements for such weights per unit area have shown that most of the coincidence effects i.e. the reduction of sound insulation occur in the above-indicated frequency range.

Considerable efforts have been made to increase the airborne-sound insulation to plate-like components. In principle this can be achieved by increasing the weight per unit area of a plate by covering it with an additional mass and/or by reducing its inherent rigidity, so that the breakdown in the mass law only occurs at a frequency above 3000 Hz.

It is known to join a plate to a lead sheet, which leads to a very good effect in the case of thin support plates because breakdown occurs over 3000 Hz. In the case of thicker plates breakdown occurs at below 3000 Hz and the per se known reduction of the airborne sound insulation occurs, so that the transmission loss is well below the theoretical value.

It is also known to increase the weight of a plate with sandbags. Although this initially leads to a good action in time this action is reduced, because cavities occur due to settlement of the sand, so that the transmission loss drops. Satisfactory results are also not obtained when cavities in extruded plates are filled with sand, because the sand is deposited in the relatively large cavities which leads to a reduction in the sound insulation. The one-sided crosswise slotting of plates is also known, which leads to a displacement of the frequencies in which the coincidence effects occur towards higher frequencies. Insulating sheets are known which are made from heavy plastics or have granular materials incorporated into the plastic, but here again the coincidence effects occur in the indicated frequency range.

The problem of the invention is to so construct a component of the aforementioned type that coincidence effects substantially no longer occur in the indicated frequency range of 60–3200 Hz.

According to the invention this problem is solved in that the component has a plurality of chambers separated from one another by walls and filled with a granular or particulate material.

The invention is described in greater detail hereinafter relative to a number of embodiments and the attached drawings, wherein shown:

FIG. 1 a view of a component for airborne-sound insulation made from corrugated board.

Figure 2:
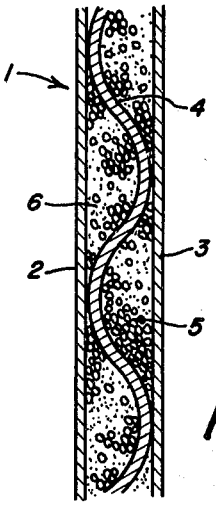

FIG. 2 a section along the line II—II of FIG. 1 on a greatly enlarged scale.

Figure 3:
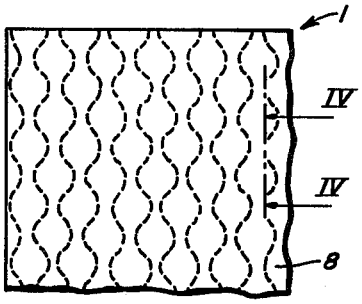

FIG. 3 a view of a further component for airborne-sound insulation.

Figure 4:
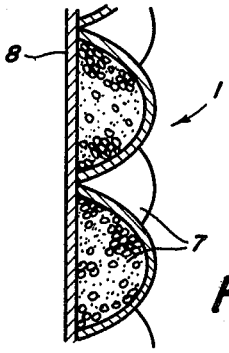

FIG. 4 a sectional along the line IV—IV of FIG. 3 on a greatly enlarged scale.

Figure 5:
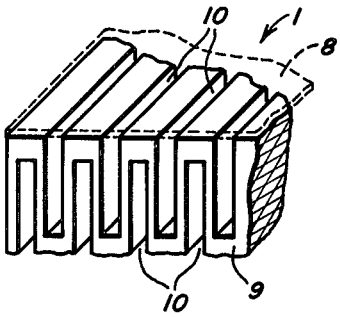

FIG. 5 a three-dimensioned view of a third component for airborne-sound insulation in the form of a soft fibreboard.

Figure 6:
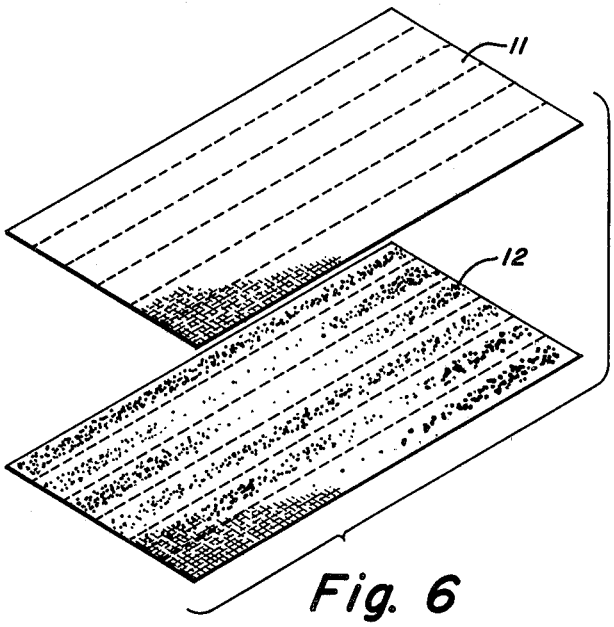

FIG. 6 An exploded three-dimensional view of a further component for airborne-sound insulation in the form of stitched material webs.

The invention is based on the idea of constructing a component for airborne-sound insulation in such a way that coincidence effects do not occur. If such components are joined in plate-like building materials having pronounced coincidence effects, the latter are to be considerably reduced or made ineffective. Firstly the weight per unit area of the plate-like building material, e.g. a wood chipboard, a cement-joined board or a gypsum plate or the like is increased and as is known this also increases the sound insulation.

In the case of component 1 shown in FIGS. 1 and 2 a corrugated board formed from two outer sheets 2, 3 and a corrugated central sheet 4 is used, whereby the cavities formed between the sheets 2, 3 and 4 form chambers 5, 6 which are filled with a pulverulent or granular material. The material is formed from individual particles or grains. As is apparent from FIG. 1 chambers 5, 6 are directed horizontally, which is important in order to obtain a limited height of the material in the vertical direction. However, the linear extension in the horizontal direction can be of a random nature. It is also advantageous if the walls of chambers 5, 6 formed by sheets 2, 3, 4 are flexible. Thus, sheets 2, 3, 4 can be formed from other flexible materials than board.

Component 1 shown in FIGS. 3 and 4 is similar to that of FIGS. 1 and 2. Here again chambers 7 are formed, but they are shaped in bulge-like manner and are covered by a sheet 8. The chambers 7 are juxtaposed and staggered relative to one another, whilst also being filled with a pulverulent or granular material.

FIG. 5 shows another sound insulating component, e.g. formed from a soft fibreboard 9. Slots 10 are provided in board 9 and are filled with pulverulent or granular material and are then sealed with a not shown sheet. Here again it is important that the material of board 9 is flexible or becomes flexible due to the incorporated slots 10. As shown in FIG. 5 the slots 10 can be provided on both sides. However, the slots 10 need only be provided on one side of board 9.

As stated hereinbefore the walls of chamber 5, 6, 7 can be made from different materials, e.g. paper, plastic or metals. It is also possible to use wood or mineral fibre materials, cf. FIG. 5. The chambers can also be formed from textiles. As shown in FIG. 6, for example, two material webs 11, 12 can be stitched together and the pulverulent or granular material can be located between the seams. If long and narrow channels are formed, they are to be positioned horizontally.

The pulverulent or granular material can also be formed from different substances, e.g. small steel or glass balls, mineral substances (sand), nonferrous metals and plastics. The material used for the walls and for the pulverulent and granular substance are selected for the particular application in question.

Component 1 can be used for forming walls, ceilings and door panels and is appropriately fixed to a dimensionally stable support, e.g. by adhesion or glueing. The effect of this component is explained relative to the following example.

If a 19 mm thick chipboard is used alone for the airborne-sound insulation, the transmission loss as a function of the frequency has coincidence effects in the range 1500–2000 Hz, leading to the breakdown in the mass law. However, if this chipboard is covered by a component according to FIG. 1 no coincidence effects occurs in the important range between 100 and 4000 Hz. Whereas the airborne-sound insulation index $I_a$ (according to ISO recommendation R 717/1968) is 29 dB in the case of the board covered with component 1 of FIG. 1 this rises to 40 dB and with a weight per unit area of 31 $kg/m^2$ is only just below the theoretical value of 42 dB. There are probably different reasons for this surprising behaviour, which differs completely from that of known constructions.

Firstly, as a result of the previously described construction of the component an approximately uniform distribution of the pulverulent or granular material is obtained over the entire component surface area without any settling of the material being possible, as is the case with a continuous vertical chamber. A settlement of the material is substantially unavoidable. However, by subdividing the gap as is done with the construction of FIG. 2 and approximately with that of FIG. 5 into horizontally extending chambers the settlement of the material is prevented or at least greatly reduced. The same is achieved when providing small individual chambers, as in the construction of FIG. 4. In all cases it is important that the chamber height is very small in the vertical direction, e.g. approximately 3–10 mm. A metallic material in the form of steel balls was used as the granular material in the aforementioned example. The spherical material has a limited particle size distribution, which facilitates a regular pouring distribution, so that settlement or collapse cannot occur in the way that may well be possible with other, e.g. mineral materials. The small steel balls are only in contact with one another in punctiform manner and therefore ensure minimum dynamic rigidity. In the case of mineral granules, e.g. sand there is meshing between the individual granules, so that their free mobility is removed. This probably disadvantageous phenomenon does not occur with metallic spherical particles. Due to its greater specific gravity the internal damping of the metallic granular material is greater than that of sand.

I claim:

1. An airborne sound attenuating construction for use in walls, doors, and the like, comprising:

means elongated in a vertical and a horizontal dimension for providing flexible walls defining a plurality of chambers spaced apart in at least said vertical dimension;

a spherical metallic granular material consisting of a plurality of steel spheres;

said spherical metallic granular material disposed in each of said chambers in close-packing relationship; and each of said chambers having a shape dimensiond to restrict settling movement of said spherical metallic granular material consisting of said plurality of steel spheres disposed therein in close-packing relationship, and wherein said walls defining said plurality of chambers are spaced apart approximately from 3 to 10 millimeters for forming said shape dimensioned to restrict settling movement of said spherical metallic granular material.

2. The airborne sound attenuating construction of claim 1, wherein said walls define a plurality of chambers spaced apart in both of said dimensions.

3. The airborne sound attenuating construction of claim 1, wherein said means elongated in said dimensions comprises a corrugated board, and wherein said chambers are the material-free cavities of said corrugated board.

4. The airborne sound attenuating construction of claim 1, or claim 2 wherein said flexible walls define bulge-like chambers, and further including a sheet adhesively fastened over said bulge-like chambers.

5. The airborne sound attenuating construction of claim 1, or claim 2 wherein said flexible material elongated in said dimensions comprises a sheet of fabric, and further including a second sheet of fabric, and wherein said plurality of chambers are constructed as stitched cavities located between said sheets of fabric.

6. The airborne sound construction apparatus of claim 1 wherein said means elongated in said dimensions comprises a soft fibreboard having parallel walls, and wherein said chambers comprise the slots formed between said parallel walls, and further including a flexible covering fastened over said slots.

7. The airborne sound attenuating construction of claim 1, claim 2, or claim 3 further including a plate-like support, and wherein said airborne sound attenuating construction is joined to said plate-like support.

* * * * *

UNITED STATES PATENT AND TRADEMARK OFFICE

CERTIFICATE OF CORRECTION

PATENT NO. : 4,441,581

DATED : April 10, 1984

INVENTOR(S) : Rudolf Sommerhalder

It is certified that error appears in the above-identified patent and that said Letters Patent is hereby corrected as shown below:

Column 2, line 5, "shown:" should read --is shown:--;
line 12, "sectional" should read --section--;
line 15, "three-dimensioned" should read --three-dimensional--.

Signed and Sealed this

*Thirteenth* Day of *November 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,441,581

DATED : April 10, 1984

INVENTOR(S) : Rudolph Sommerhalder

It is certified that error appears in the above—identified patent and that said Letters Patent is hereby corrected as shown below:

Column 4, lines 38-39, "said flexible material elongated" should read --said means elongated--.

Signed and Sealed this

*Twelfth* Day of *March 1985*

[SEAL]

*Attest:*

DONALD J. QUIGG

*Attesting Officer* *Acting Commissioner of Patents and Trademarks*